US006816039B1

(12) United States Patent
Taylor et al.

(10) Patent No.: US 6,816,039 B1
(45) Date of Patent: Nov. 9, 2004

(54) COAXIAL SPLIT-BEAD GLASS-TO-METAL SEAL FOR HIGH FREQUENCY TRANSMISSION LINE

(75) Inventors: Donald J. Taylor, Healdsburg, CA (US); Matthew R. Richter, Santa Rosa, CA (US); Zahn Zhang, Healdsburg, CA (US); Glenn S. Takahashi, Santa Rosa, CA (US)

(73) Assignee: Agilent Technologies, Inc., Palo Alto, CA (US)

( * ) Notice: Subject to any disclaimer, the term of this patent is extended or adjusted under 35 U.S.C. 154(b) by 0 days.

(21) Appl. No.: 10/618,214

(22) Filed: Jul. 10, 2003

(51) Int. Cl.[7] ..... H01P 3/06

(52) U.S. Cl. ..... 333/243; 333/244; 333/245; 439/578

(58) Field of Search ..... 333/243–245, 333/236, 254, 260; 439/578

(56) References Cited

U.S. PATENT DOCUMENTS 3,544,928 A * 12/1970 Keiter ..... 333/245
4,035,054 A 7/1977 Lattanzi ..... 439/578
4,669,805 A 6/1987 Kosugi et al. ..... 439/581
5,696,474 A 12/1997 Spivey et al. ..... 333/245
6,666,725 B2 * 12/2003 Botka et al. ..... 439/675

OTHER PUBLICATIONS

Agilent Technologies, Inc. USSN 10/226,586 filed with USPTO on Aug. 23, 2002, Inventors Hubert Yeung, Michael T. Powers, and Wesley C. Whiteley.

* cited by examiner

*Primary Examiner*—Barbara Summons
(74) *Attorney, Agent, or Firm*—Robert T. Martin

(57) ABSTRACT

Support structure for high frequency coaxial transmission line. A conductive bead ring is split in two halves longitudinally, containing a relief for excess glass flow and provision for locking the halves together. A glass dielectric surrounds the center conductor, which is tapered from a first larger diameter to a second smaller diameter in the region of the glass dielectric. A fixture for forming the glass to metal seal uses dams to control the positioning of the glass with respect to the taper in the center conductor.

6 Claims, 4 Drawing Sheets

COAXIAL SPLIT-BEAD GLASS-TO-METAL SEAL FOR HIGH FREQUENCY TRANSMISSION LINE

BACKGROUND OF THE INVENTION

1. Field of the Invention

The present invention pertains to the art of high frequency coaxial transmission lines, and more particularly to the art of forming glass-to-metal seals in high frequency coaxial transmission lines.

2. Art Background

Transmission lines for high frequency signal propagation typically consist of two conductors separated by a dielectric material that can hold an electric charge. The two important characteristics of a transmission line are its impedance and maximum operating frequency, both of which are determined by the relative size and spacing of the conductors and the dielectric constant of the material separating them. Maximum operating frequency is limited by the fact that if the dimensions of the transmission line are greater than a certain fraction of the wavelength that is being propagated, then unwanted modes develop which are detrimental. Therefore, as the operating frequency of the transmission line increases, the characteristic dimensions of the transmission line components must be decreased. Control of line impedance is critical since a fraction of the signal is reflected whenever there is an impedance mismatch. As a result, it is necessary to maintain constant impedance through the entire signal path in order to minimize the amount of unwanted reflections that occur when there is a mismatch.

Air is a common dielectric used in high frequency coaxial transmission lines. Such transmission lines require supports to maintain the coaxial placement of the center conductor, and also require supports at connectors. In such supports, a different dielectric material, such as a fluorinated polymer, ceramic, glass, or glass-ceramic material is used. As such materials represent a change in dielectric constant from air, the geometry of the transmission line must be altered to maintain as close to a constant impedance as possible. Since the dielectric constant of the material used to support the center conductor is typically higher than that of air, the diameter of the inner conductor must be reduced, or the diameter of the outer conductor increased, in order to maintain pro per impedance. At higher frequencies, the line is more susceptible to discontinuities and the geometry of the air to glass transition must be closely controlled.

The placement of the support with respect to the change in diameter of the center conductor is also critical. The geometry of this transition region must be carefully controlled to maintain the required characteristic impedance through the tapered transition region, and to minimize reflections. Particularly at millimeter-wave frequencies, small shifts or distortions in the relative position of the support to the tapered center conductor can result in changes in return loss on the order of 30 dB or more. Therefore, tolerances in the support must be carefully controlled.

The seal between the support and conductors in a typical glass to metal seal results from either chemical bonds that form between the glass and metal, depending on the composition of the metal, or compressive stresses that develop in the glass during processing. Compressive stresses develop when the coefficient of thermal expansion of the metal exceeds that of the glass, and are desirable in that it increases the ruggedness of the structure. Glass is very weak in tension, which develops when the center conductor is flexed radially. If the glass is pre-stressed compressively, these forces must be overcome before the tensile strength of the glass becomes a concern. As the dimensions of the transmission line decrease, however, it is more difficult to achieve the pre-stressing that is necessary for good reliability in the field.

SUMMARY OF THE INVENTION

A support structure for high frequency coaxial transmission lines uses a split conductive bead having locking provisions and relief areas to contain excess glass from the dielectric glass bead sections surrounding the tapered center conductor. A fixture for forming the glass to metal seal controls the positioning of the glass with respect to the taper in the center conductor.

DESCRIPTION OF THE DRAWINGS

The present invention is described with respect to particular exemplary embodiments thereof and reference is made to the drawings in which.

DETAILED DESCRIPTION

Transmission lines for high frequency signal propagation typically consist of two conductors separated by a material that can hold an electric charge (a dielectric). There are two important characteristics of a transmission line: its impedance and maximum operating frequency, both of which are determined by the relative size and spacing of the conductors, and the dielectric constant of the material separating them. Maximum operating frequency is limited by the fact that if the dimensions of the transmission line are greater than a certain fraction of the wavelength that is being propagated, then unwanted modes develop which are detrimental. Therefore, as the operating frequency of the transmission line increases, the characteristic dimensions of the transmission line components must be decreased. Control of line impedance is critical since a fraction of the signal is reflected whenever there is an impedance mismatch. As a result, it is necessary to maintain constant impedance through the entire signal path in order to minimize the amount of unwanted reflections that occur when there is a mismatch.

Figure 1:
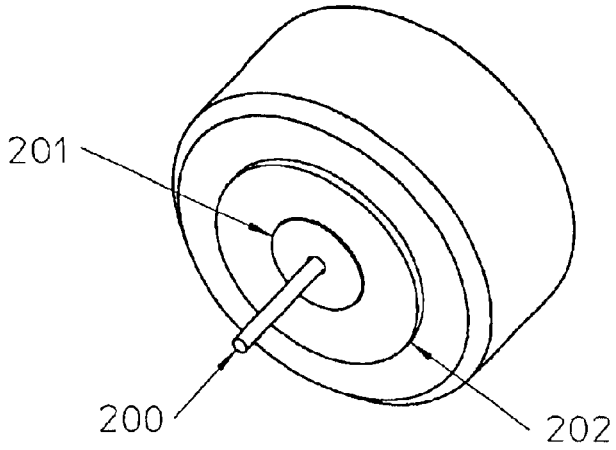
FIG. 1 Prior Art
FIG. 1 shows a coaxial line.

In the case of high-frequency coaxial structures, air is commonly used as the dielectric, with a glass-to-metal seal used as a support to suspend the center conductor concentrically with respect to the outer conductor, as shown in FIG. 1. Since the dielectric constant of the material 201 used to support the center conductor 200 is typically higher than that of air, the diameter of the inner conductor 200 must be reduced, or the inner diameter of the outer conductor 202 increased, in order to maintain proper impedance. At higher frequencies, the line is more susceptible to discontinuities and the geometry of the air to glass transition must be closely controlled. As used herein, the nominal term "glass" refers to suitable dielectric materials which include, glass, ceramics, vitrified glasses, and similar materials known to the art.

The seal between the dielectric and conductors in a typical glass to metal seal results from either chemical bonds that form between the glass and metal, depending on the composition of the metal, or compressive stresses that develop in the glass during processing. Compressive stresses develop when the coefficient of thermal expansion of the metal exceeds that of the glass, and are desirable in that it increases the ruggedness of the structure. Glass is very weak in tension, which develops when the center conductor is flexed radially. If the glass is pre-stressed compressively, these forces must be overcome before the tensile strength of the glass becomes a concern. As the dimensions of the transmission line decrease, however, it is more difficult to achieve the pre-stressing that is necessary for good reliability in the field.

Glass-to-metal seals are generally produced by assembling the center and outer conductor with a glass preform, and then heating the assembly until the glass starts to flow. Typically the conductors are loaded vertically, and pressure is applied by using a weight that has clearance between the conductors and which rests on the glass. Axial pressure on the glass forces it to flow between the center and outer conductors. This type of loading, however, can limit the types of geometries that can be produced in the area of the air to dielectric transition. An example of a structure that is impractical to produce with conventional axial loading is shown in FIG. 2.

Figure 2:
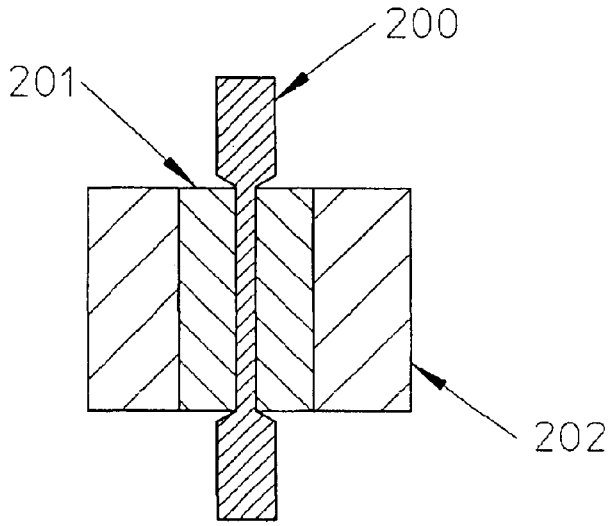
FIG. 2 shows a cross-section of a coaxial line.
Figure 3:
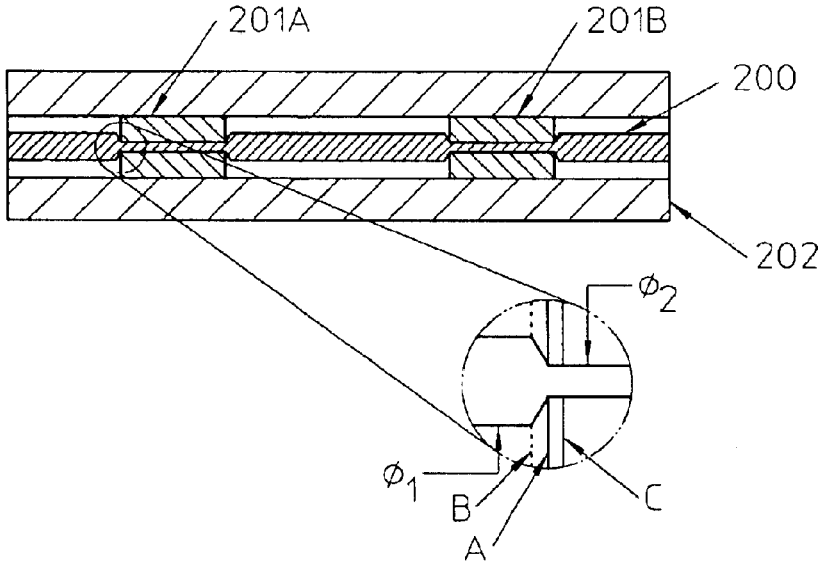
FIG. 3 shows a detailed cross-section of a coaxial line.

Using the High Frequency Structure Simulator (HFSS) system from Agilent Technologies, Inc, simulating frequencies up to 200 GHZ demonstrated that the air to glass dielectric transition in FIG. 2 has excellent electrical performance, provided that the termination of the glass is accurately positioned with respect to the end of the taper. The structure that was simulated is shown in FIG. 3, with three positions of the air/glass dielectric interface labeled A, B, and C, with position A preferred. For these simulations, the glass beads are 2 mm long and spaced 7 mm on center. The diameter of the center conductor with the air dielectric is 0.5842 mm ($\theta_1$), with the glass dielectric 0.0889 mm ($\theta_2$), and the taper of the transition between the two makes an angle of 60° with the horizontal. Position C corresponds to a distance of 0.0254 mm from the end of the taper to the start of the glass. Simulation shows that a small variation in the position of the axial termination of the glass from the preferred position A results in a considerable impact on connector performance, with the return loss ($s_{11}$, a measure of performance) varying in some cases over 30 dB. Thus, the position of the glass with respect to the taper must be very carefully controlled.

Figure 4:
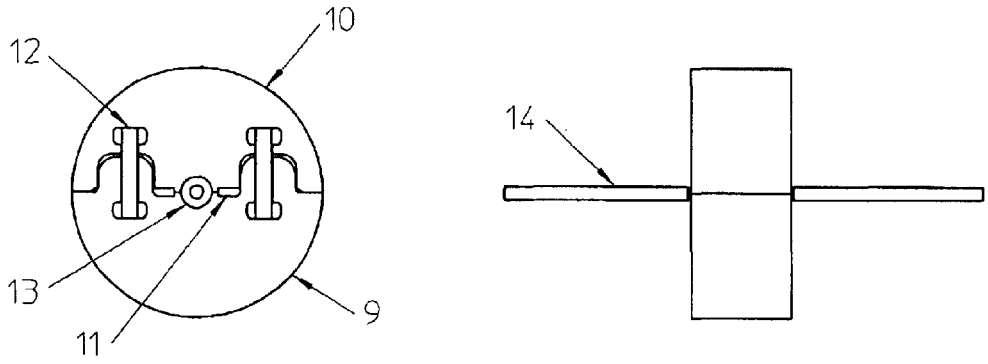
FIG. 4 shows a support structure according to the present invention.
Figure 5:
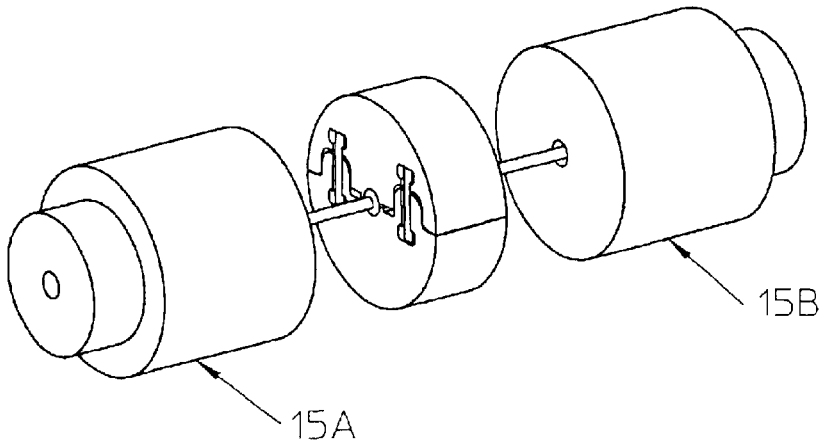
FIG. 5 shows a coaxial line according to the present invention.

This invention provides a means by which to produce a glass to metal compression seal with the necessary control over the termination of the glass for good electrical performance from DC to mm-wave frequencies and above. The invention includes provisions for accommodating tolerances inherent to the components of the assembly, and means to control the amount of compressive stress in the glass. An embodiment of the invention, shown in FIG. 4, consists of a conductive bead ring that is split in two longitudinally 9, 10, containing a relief for excess glass flow 11, and optional provision for locking the halves together 12. As illustrated in FIG. 5, a transmission line can be formed with the bead ring by pressing sleeves 15 against each face that are bored with the proper diameter to form the outer conductor of the coaxial structure. This type of configuration might form the transmission line in a coaxial connector. The bead ring of the present invention allows a means by which to produce the configuration of the air-to-glass transition shown in FIGS. 2 and 3.

The bead ring 9, 10 and glass materials 13 should be selected in terms of their thermal expansion compatibility. One example of such a combination that results in a compression seat is AISI 1215 steel for the be ad ring material, and type 8250 borosilicate glass for the dielectric. Similarly, a combination of Kovar™ for the bead ring material and borosilicate glass for the dielectric results in a matched seal. Many metal/dielectric combinations are possible.

If used, locking provision 12 may use a braze material preform having a melting temperature above the softening point of the glass 13 used. One example is a silver-copper material (72% Ag/28% Cu), which has a melting point about 100 degrees C. above the softening point of borosilicate glasses.

Figure 6:
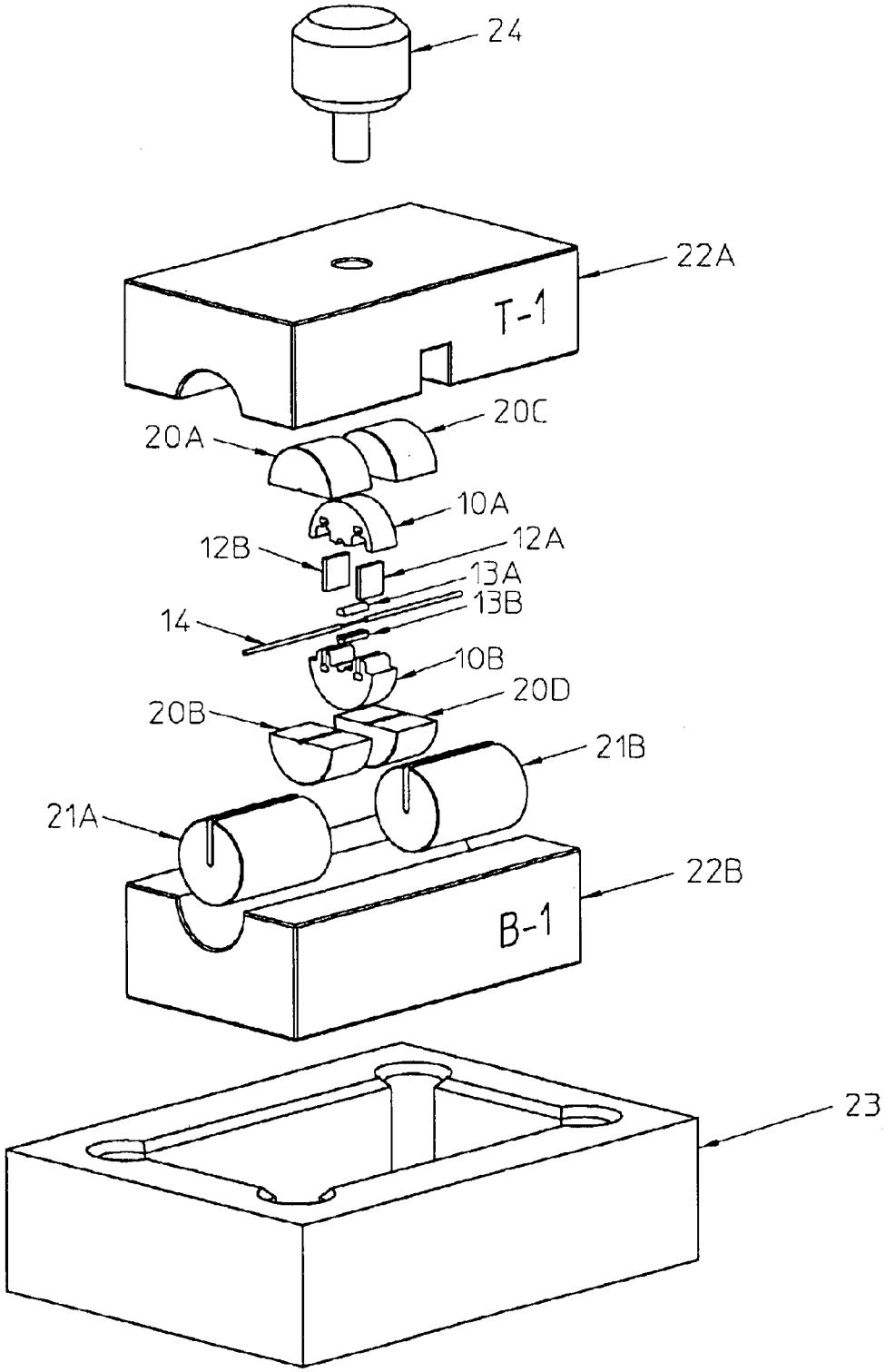
FIG. 6 shows a tool according to the present invention.

One embodiment for manufacturing the bead ring is shown in FIG. 6. Between blocks 22*a*, 22*b* that have a half-round feature to provide alignment, conductive bead halves 10*a*, 10*b*, glass preforms 13*a*, 13*b* and center conductor 14 are assembled between dams 20*a*, 20*b*, 20*c*, 20*d*, which are relieved to accept the taper on the center conductor. Spacers 21*a*, 21*b* are placed at the ends of the dams 20*a*, 21*b*, 20*c*, 20*d* and the assembly in blocks 22*a*, 22*b* is placed in a nest 23 such that its axial movement is limited. Weight 24 is placed on the top half 22*a* of the split bead assembly and the entire assembly is heated until the glass 13*a*, 13*b* begins to flow. Once the assembly has reached an appropriate temperature, the bead halves are pressed together by the weight.

The longitudinal split of the bead ring differentiates this glass to metal seal from others and aids in controlling the final configuration of the glass. The split in the bead ring allows the glass to be compressed radially during processing, as compared to traditional met hods in which it is compressed axially. This is significant because fixed dams 20*a*, 20*b*, 20*c*, 20*d* that capture the tapered profile can then be used to precisely position the glass and restrict its flow into the transition between the two different diameters on the center conductor. Since the ends are captivated when the glass flows, voids 11 shown more clearly in FIG. 4 are provided radially to accept excess glass when the assembly is heated and the halves are pressed together. This accommodates the tolerance stack-up of the glass preforms and bore which are inherent in the manufacturing process.

In order to captivate the glass as the halves are pressed together, some sort of to compression between the dams and bead ring is required. One method of doing this is to fabricate the spacers out of a material with a coefficient of thermal expansion that is greater than that of the nest. As the assembly is heated differential expansion of the spacers relative to the nest provides the necessary compression. Additionally, the load required to drive the halves of the bead ring to together at an elevated temperature can be provided in a similar manner by taking advantage of thermal expansion mismatch in the tooling rather than using a weight as previously described.

Since it is desirable to have compressive stresses develop in the glass it is advantageous to incorporate a locking mechanism between the bead ring halves. There are various means by which to accomplish this, including braze material or a mechanical feature. In any case, careful design of the locking feature allows the temperature at which the halves come together to be controlled. Control over the temperature at which the halves are joined is advantageous in that, due to the expansive nature of the materials at elevated temperatures, the temperature at which the halves are united affects the volume of glass captured. Upon cooling, due to the thermal mismatch between the glass and metal, compressive stresses develop in the glass that are a function of the volume captured. As a result, the split bead design controls the degree of preloading on the glass. This is critical in light of the fact that, as mentioned previously, with smaller geometries it is more difficult to generate the prestress conditions required for sufficient reliability.

The foregoing detailed description of the present invention is provided for the purpose of illustration and is not intended to be exhaustive or to limit the invention to the precise embodiments disclosed. Accordingly the scope of the present invention is defined by the appended claims.

What is claimed is:

1. A support for the center conductor of a coaxial cable comprising:

a dielectric for surrounding the center conductor, a first conductive bead ring portion and a second bead ring portion, the first and second bead ring portions joining longitudinally, a first cylindrical recess coaxially formed in the first and second bead ring portions for containing the dielectric, and a second recess formed in the first and second bead ring portions, the second recess connected to the first recess, the second recess for containing excess dielectric.

2. The support of claim 1 further comprising locking means locking the first and second conductive bead ring portions together.

3. The support of claim 2 where the locking means comprises braze material.

4. A method of forming a support for the center conductor of a coaxial cable, the center conductor tapering from a first diameter on both sides of the support to a second smaller diameter in the region of the support, the method comprising:

placing dielectric preforms around the center conductor in the region having the second smaller diameter, providing longitudinally split conductive bead rings surrounding the dielectric preforms, the conductive bead rings having a first cylindrical recess coaxially formed for containing the dielectric preforms and the center conductor, the conductive bead rings having a second recess connected to the first recess for containing excess dielectric, the conductive bead rings, dielectric preforms, and center conductor forming a support assembly, nesting the support assembly between dams having tapered recesses matching the tapering of the center conductor, nesting the support assembly and the dams in a tool nest to form a tool nest assembly, and heating the tool nest assembly.

5. The method of claim 4 where the step of forming a support assembly further comprises:

providing locking recesses in the conductive bead rings, and providing locking material in the locking recesses.

6. A method of forming a support for the center conductor of a coaxial cable, the center conductor tapering from a first diameter on both sides of the support to a second smaller diameter in the region of the support, the method comprising:

placing dielectric preforms around the center conductor in the region having the second smaller diameter, providing longitudinally split conductive bead rings surrounding the dielectric preforms, the conductive bead rings having a first cylindrical recess coaxially formed for containing the dielectric preforms and the center conductor, the conductive bead rings having a second recess connected to the first recess for containing excess dielectric, providing locking recesses in the conductive bead rings, and providing locking material in the locking recesses, the conductive bead rings, locking material, dielectric preforms, and center conductor forming a support assembly, nesting the support assembly between dams having tapered recesses matching the tapering of the center conductor, placing spacers at the ends of the dams, nesting the support assembly, spacers, and the dams in a tool nest to form a tool nest assembly, placing a weight on top of the tool nest assembly, and heating the tool nest assembly.

* * * * *